US005566754A

United States Patent [19]

Stokka

[11] Patent Number: 5,566,754

[45] Date of Patent: Oct. 22, 1996

[54] CENTRALISERS

[75] Inventor: Arnold Stokka, Sandnes, Norway

[73] Assignee: Weatherford/Lamb, Inc., Houston, Tex.

[21] Appl. No.: 388,603

[22] Filed: Feb. 14, 1995

[30] Foreign Application Priority Data

Sep. 24, 1994 [GB] United Kingdom ..... 9419313

[51] Int. Cl.[6] ..... E21B 17/10

[52] U.S. Cl. ..... 166/241.6

[58] Field of Search ..... 166/241.1–241.7

[56] References Cited

U.S. PATENT DOCUMENTS

| | | | |
|---|---|---|---|
| 2,295,803 | 7/1940 | O'Leary | 166/9 |
| 2,424,027 | 7/1947 | Gist | 166/4 |
| 2,659,439 | 11/1953 | Baker | 166/4 |
| 2,715,552 | 8/1955 | Lane | 308/4 |
| 2,973,996 | 3/1961 | Self | 308/4 |
| 3,045,767 | 7/1962 | Klassen | 175/76 |
| 3,049,382 | 7/1962 | Ell | 308/4 |
| 3,124,196 | 3/1964 | Solum | 166/241.6 |
| 3,320,004 | 5/1967 | Garrett | 308/4 |
| 3,397,017 | 7/1968 | Grant et al. | 308/4 |
| 3,762,472 | 10/1973 | Alexander, Jr. | 166/241 |
| 4,042,022 | 7/1977 | Wills et al. | 166/241 |
| 4,077,470 | 3/1978 | Dane | 166/244 R |
| 4,133,470 | 1/1979 | Trail | 228/44.1 R |
| 4,363,360 | 12/1982 | Richey | 166/241 |
| 4,531,582 | 7/1985 | Muse et al. | 166/241 |
| 4,601,334 | 7/1986 | Lovegrove | 166/241 |
| 4,681,161 | 7/1987 | Arterbury et al. | 166/241.6 X |
| 4,787,458 | 11/1988 | Langer | 166/380 |
| 4,794,986 | 1/1989 | Langer | 166/241 |
| 4,875,524 | 10/1989 | Bradley et al. | 166/241.6 |
| 4,984,633 | 1/1991 | Langer et al. | 166/241 |
| 5,095,981 | 3/1992 | Mikolaiczk | 166/241.6 |
| 5,228,518 | 7/1993 | Wilson et al. | 166/369 |
| 5,238,062 | 8/1993 | Reinholdt | 166/241.7 |
| 5,261,488 | 11/1993 | Gullet et al. | 166/241.7 |
| 5,377,751 | 1/1995 | Uherek et al. | 166/241.6 |

OTHER PUBLICATIONS

Baker Oil Tools Primary Cementing, pl 20, Baker Oil Tools, Inc. 1989.

1982–83 Catalog, pp. 8222–8224, Trico Industries, Inc., 1982.

API Specification For Casing Centralizers, American Petroleum Institute, 1986.

Proven Primary Cementing Tools, Frank's International, Inc., prior to 1994.

1982–83 Products and Services Catalog, p. 8827, Weatherford International, 1982.

The Gemoco Bore Patrol . . . Your Most Effective Attack For Positive Standoff Cementing, Gemoco Div. Sequa Engineered Services, Inc., 1991.

New "Spiral" Solid Stand–Off Centralizers, Ray Oil Tool Companies, prior to 1994.

Spiral Rigid Centralizers, Weatherford, 1990.

Cementing Program, Weatherford, 1975.

Stresses On A Centralizer, Weatherford Oil Tool Co., 1968.

1990–91 General Services and Products Catalog, Weatherford, 1990, pp. 37–40.

*Primary Examiner*—Michael Powell Buiz
*Attorney, Agent, or Firm*—Guy McClung

[57] ABSTRACT

A centraliser has been developed which in one aspect an upper ring and a lower ring connected by six rigid members. The centralizer can be mounted on casing to be lowered down deviated bores. The rigid members are designed to collapse under a lateral load of about 20 tonnes. Thus if, for example, part of the bore collapses and the casing has to be withdrawn the rigid members will collapse enabling the centralizer to be recovered on the casing, preferably in one piece.

12 Claims, 5 Drawing Sheets

CENTRALISERS

FIELD OF THE INVENTION

This invention relates to centralisers.

BACKGROUND OF THE INVENTION

During the construction of oil and gas wells a bore is drilled into the ground. Casing is then lowered into the bore and the annular space between the casing and the bore filled with cement.

It is important that the casing is held substantially centrally in the bore while the annular space is filled with cement and for this purpose centralisers are mounted on the casing as it is lowered into the bore.

Usually wellbores extend substantially vertically downwardly and the centralisers comprise two spaced apart bands which can be slipped over the casing and a plurality of spring bows which extend between and are connected to the bands.

If part of the wellbore collapses and it is necessary to withdraw the casing then the spring bows simply compress against the side of the casing as they pass through the obstruction after which they expand against the side of the bore.

More recently the demand for deviated drilling has increased significantly. In deviated drilling a branch bore, which can be nearly horizontal, is drilled outwardly from an existing vertical bore.

Many problems arise with deviated drilling. One of these problems is that centralisers with spring bows are not entirely satisfactory since the spring bows will not withstand the lateral forces as the casing turns into the branch bore. Furthermore, the spring bows are generally not strong enough to centre casing in nearly horizontal bores.

One solution to this problem is to use centralisers with rigid members instead of spring bows. Examples of such centralisers are shown in GB-A-2 171 436 and GB-A-682 362. The overall diameter of such centralisers is somewhat smaller than the bore so that said centralisers can be readily moved along the bore. Whilst such centralisers are not as versatile as centralisers with spring bows they do provide a reasonable centralising action.

The disadvantage of such centralisers is that if part of the bore collapses and it is necessary to withdraw the casing some of the rigid members are nearly always broken off as the casing is withdrawn. This is extremely undesirable since the broken fragments can later be carried to the surface and obstruct or damage flow control equipment.

SUMMARY OF THE PRESENT INVENTION

In order to help reduce this problem the present invention provides a centraliser which is provided with at least one rigid member which, when said centraliser is mounted on casing will substantially irreversibly collapse against said casing when subjected to a lateral load of from 5 to 30 tonnes.

Centralisers in accordance with the present invention can readily be distinguished from prior art centralisers which use rigid members since these were either formed by solid castings (GB-A-2 171 436), for example of aluminium or steel, or by very robust steel sections (GB-A-682 362).

Preferably, the casing will substantially irreversibly collapse against said casing when subjected to a lateral load of from 10 to 25 tonnes.

Advantageously, the casing will substantially irreversibly collapse against said casing when subjected to a lateral load of from 18 to 22 tonnes.

In a preferred embodiment the rigid member is of generally U-shape cross section.

In another embodiment the rigid member comprises a crushable material. In,this embodiment the rigid member is preferably provided with a reinforcing member to provide the centraliser with acceptable tensile strength.

The reinforcing member may comprise, for example, a metal such as steel or aluminium although it could also comprise a plastics material.

If the reinforcing member is embedded in the crushable material there will be some adhesion between the reinforcing member and the crushable material. If the crushable material becomes broken for any reason this adhesion will inhibit separation of the broken pieces from the centraliser. If desired the reinforcing member may be provided with protrusions and/or adhesive to improve the adhesion between the reinforcing member and the crushable material and to reduce the probability of any broken pieces separating from the centraliser. More generally stated, it is preferred that the reinforcing member co-operates with the crushable material to inhibit broken pieces of said rigid member separating from said centraliser.

For a better understanding of the present invention reference will now be made, by way of example, to the accompanying drawings in which:

DETAILED DESCRIPTION OF THE PREFERRED EMBODIMENTS

Figure 1:
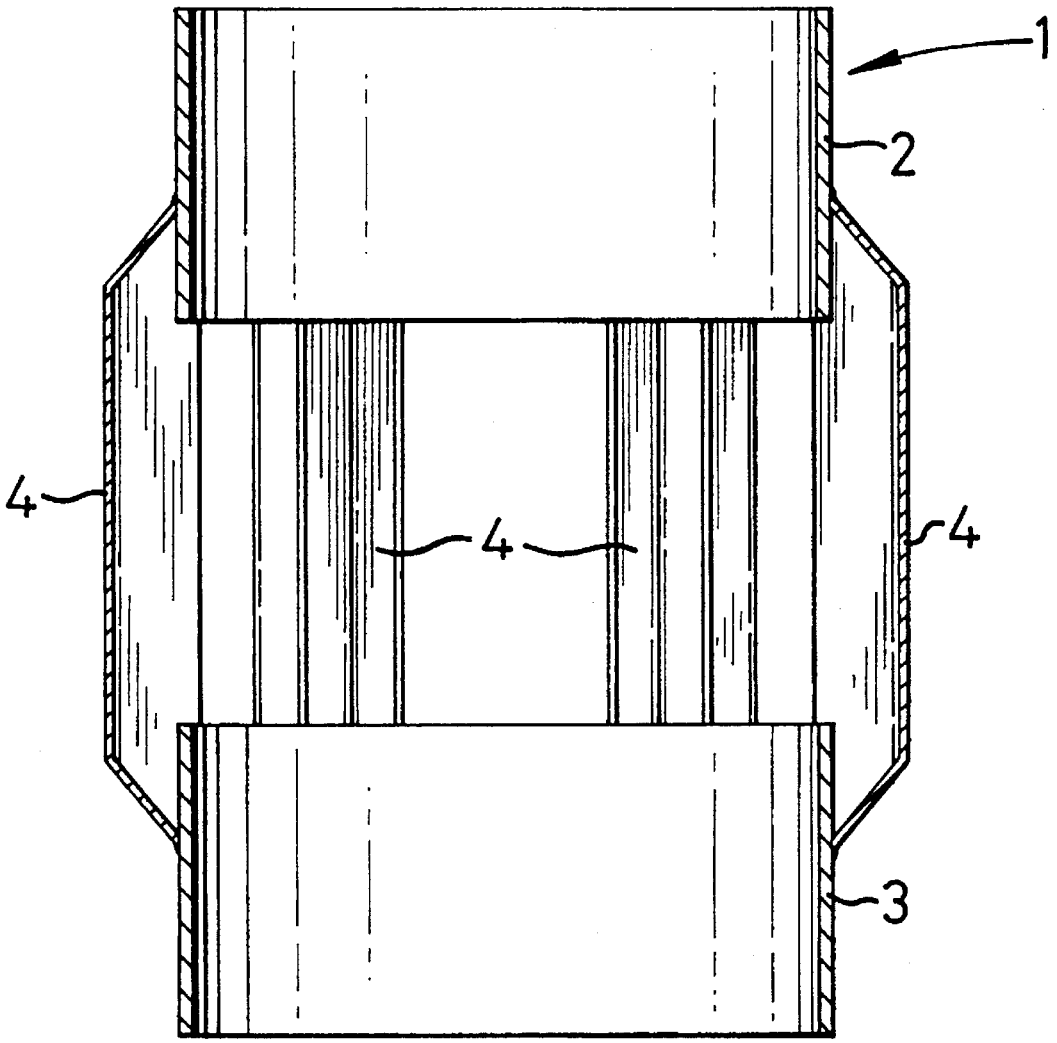
FIG. 1 is a vertical cross-section through one embodiment of a centraliser in accordance with the present invention.

Referring to the drawings there is shown a centraliser which is generally identified by the reference numeral 1. The centraliser 1 comprises an upper ring 2 and a lower ring 3 which are spaced apart and connected by six rigid members 4 which are welded to the upper ring 2 and the lower ring 3 at their respective ends.

Figure 3:
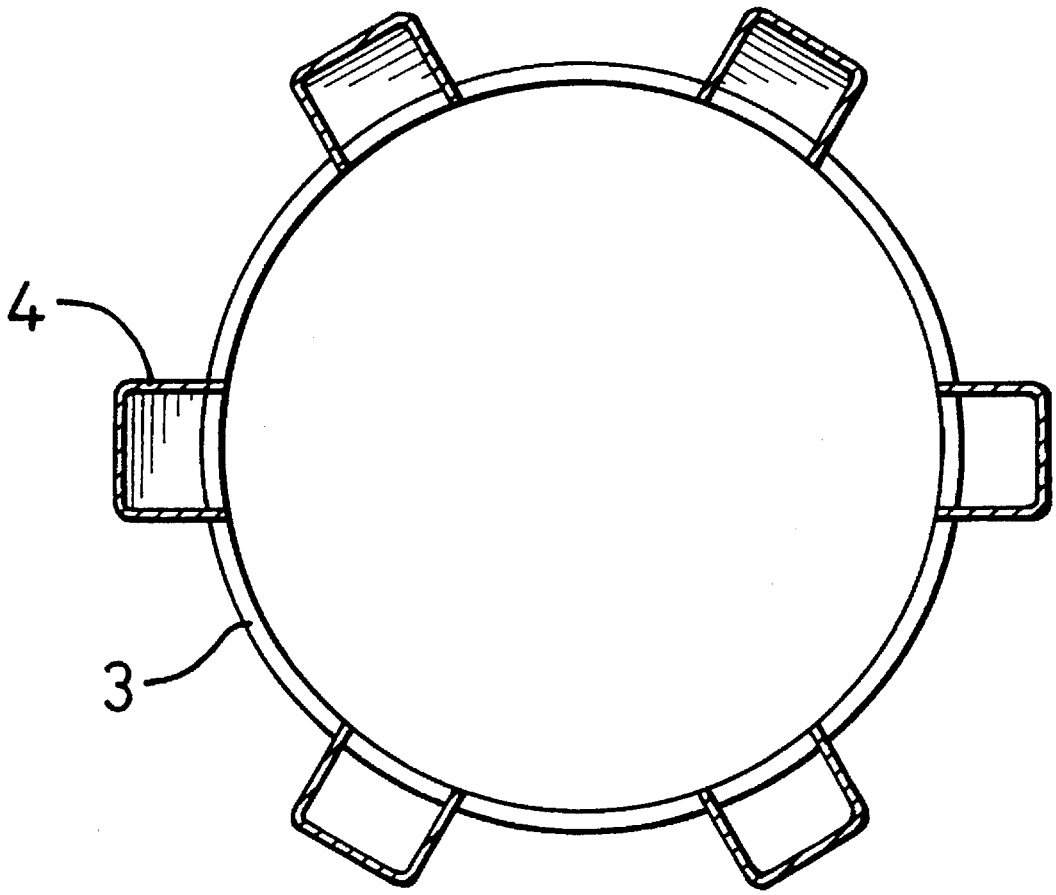
FIG. 3 is a horizontal cross-section taken on line III—III of FIG. 2.

As shown in FIGS. 1 and 3, each rigid member 4 is of generally U-shape cross-section.

Figure 2:
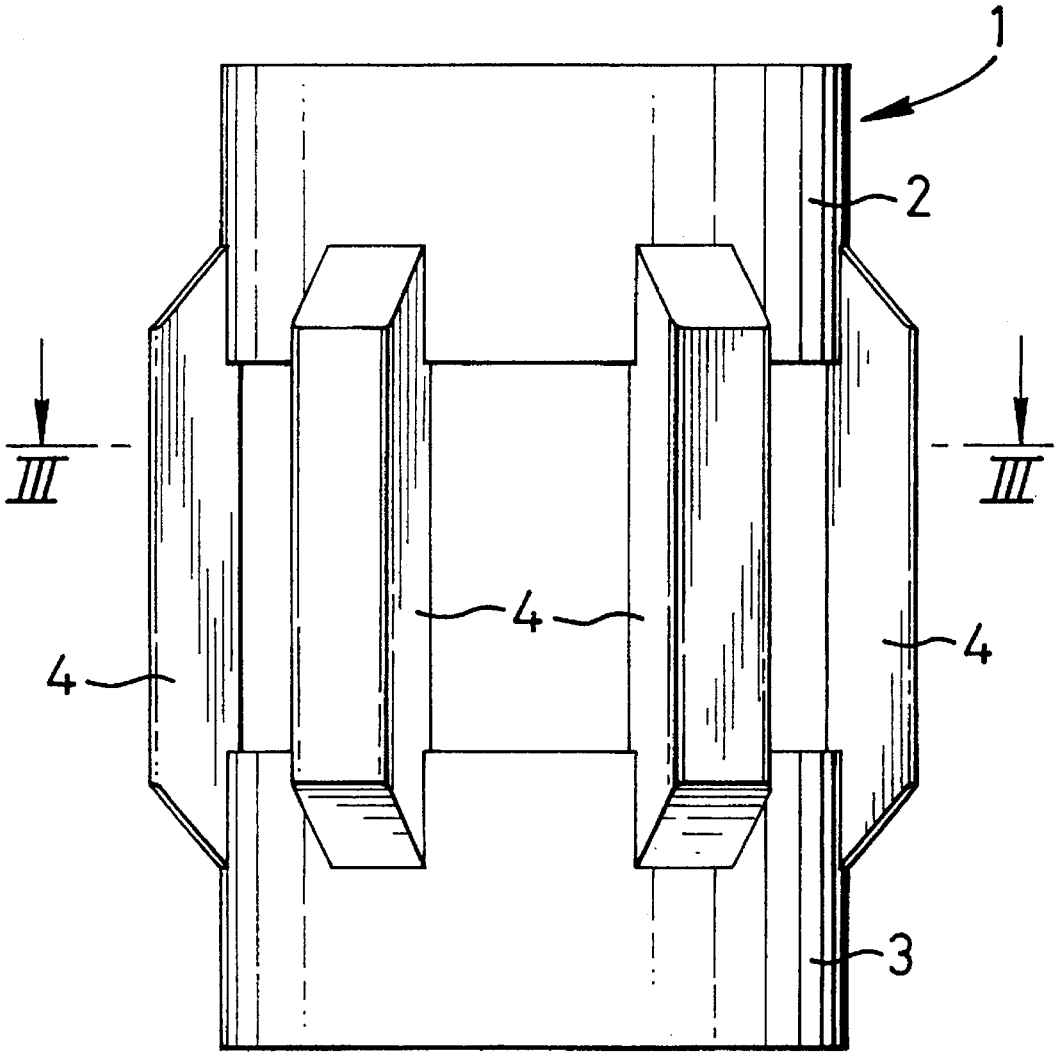
FIG. 2 is a side view of the centraliser shown in FIG. 1.

In the embodiment shown in FIGS. 1 to 3 the overall diameter of the upper ring 2 and the lower ring is approximately 180 mm. The maximum width of each rigid members 4 is approximately 45 mm and the thickness of the wall of the rigid members 4 is approximately 2 mm.

In use, as casing is being lowered own a wellbore the centralisers 1 are mounted at the desired spacing. Conveniently, the centralisers 1 are secured between two stop collars to prevent them moving along the casing.

In normal use the casing is simply lowered into a bore and cemented in position, the rigid members 4 acting as centring members. If the casing has to be withdrawn for any reason prior to cementing, for example due to collapse of part of the wellbore, the casing is simply raised by the draw works.

When the centraliser 1 is pulled through the obstruction the obstruction exerts a force on the centraliser 1. If the force is sufficient the rigid members 4 irreversibly collapse thereby enhancing the prospects of the centraliser 1 remaining in one piece on the casing.

In trials using centralisers 1 designed to fully collapse with a lateral load of 20 tonnes nearly all the centralisers 1 were recovered at the surface fully collapsed but in one piece.

Various modifications to the preferred embodiment described are envisaged. For example, the rigid members 4 could be of any convenient cross-section, for example semi-circular, arcuate or trapezoidal. If desired, the rigid members could be locally weakened to facilitate their collapse. Thus, for example the rigid members could comprise two generally aligned sections joined by, for example an epoxy resin bonding the sections together but formulated to fail under a desired load. Another alternative would be for the rigid members to comprise two generally aligned sections connected by a shear pin intended to fail at a desired load. Whilst both the alternatives just described are within the scope of the present invention the embodiment shown in FIGS. 1 to 3 is preferred as there is believed to be less chance of parts becoming detached from the centraliser after collapse of the rigid members. In another embodiment, the rigid members could be made of a crushable material, for example a cellular material. Such an embodiment is shown in FIGS. 4 and 5.

Figure 4:
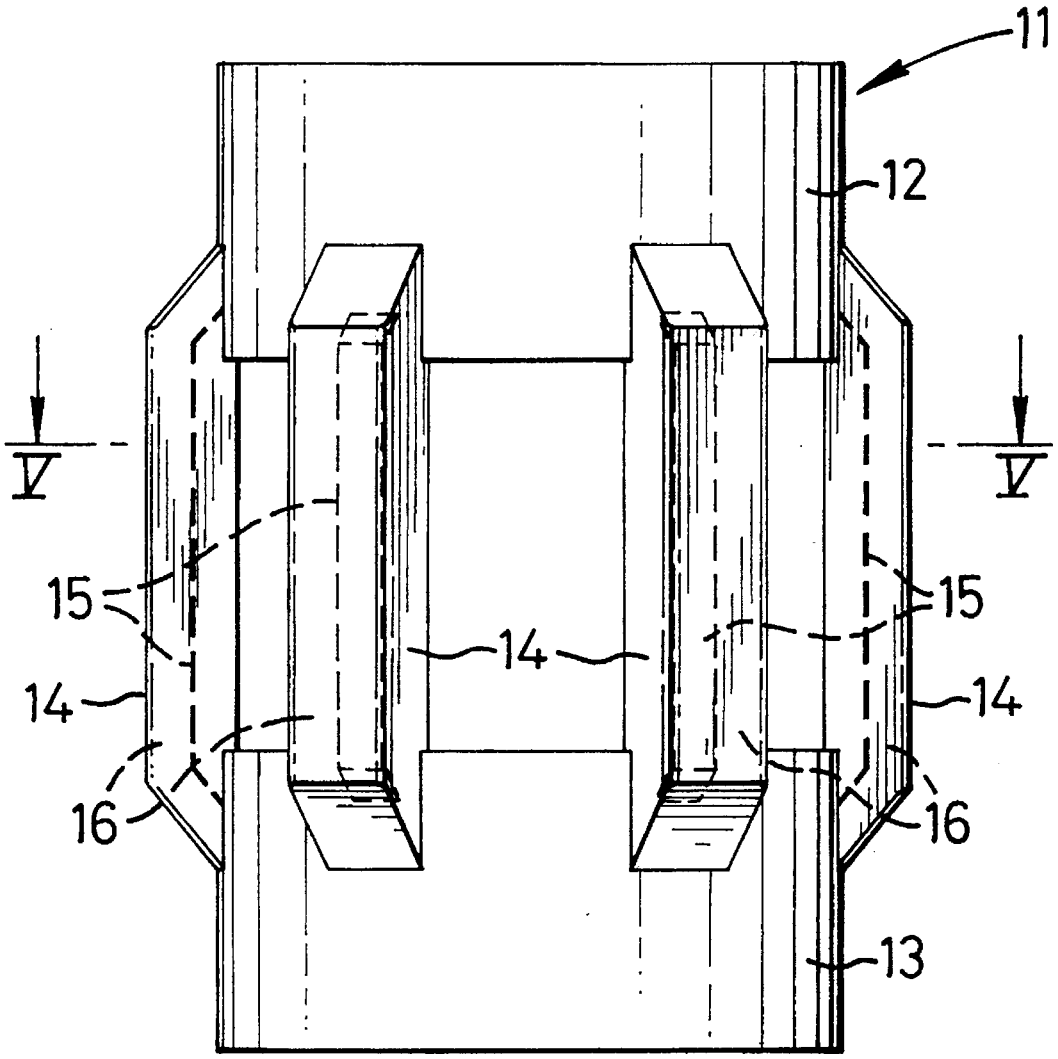
FIG. 4 is a side view of a second embodiment of a centraliser in accordance with the present invention.
Figure 5:
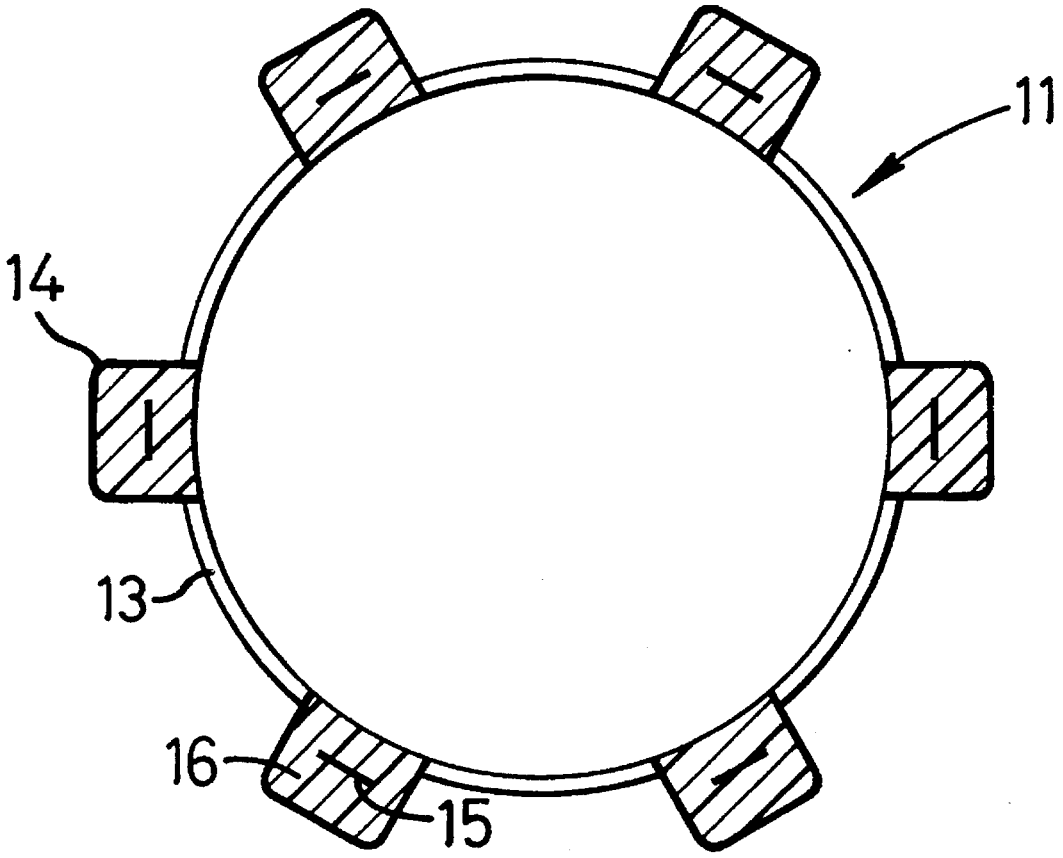
FIG. 5 is a horizontal cross-section taken on line V—V of FIG. 4.

Referring to FIGS. 4 and 5, there is shown a centraliser 11 which comprises an upper ring 12 and a lower ring 13 which are spaced apart and connected by six rigid members 14.

Each rigid member 14 comprises a thin reinforcing member 15 of metal, for example steel or aluminium, which is embedded in a crushable material comprising polyurethane foam 16. Each of the thin reinforcing members 15 is welded to the upper ring 12 and the lower ring 13 at its ends.

In use, if the centraliser 11 is withdrawn through an obstruction the polyurethane foam 16 irreversibly collapses thereby enhancing the prospects of the centraliser 11 remaining in one piece on the casing. The polyurethane foam 16 is designed to irreversibly collapse under a lateral load of about 20 tonnes.

Various modifications to the embodiment shown in FIGS. 4 and 5 are envisaged, for example the reinforcing members 15 could be separate and distinct from the rigid members 14 which could simply comprise a crushable material such as polyurethane foam. Whilst preferably made of metal, reinforcing members 15 could also be made of plastics material.

However, the arrangement described with reference to FIGS. 4 and 5 is preferred as it provides a convenient method of mounting the rigid member 14 to the upper ring 12 and lower ring 13.

What is claimed is:

1. A centraliser which comprises a first member which can be mounted around a length of casing, a second member which can be mounted around said casing, and at least one rigid member which extends between said first member and said second member, said rigid member being substantially irreversibly collapsible against said casing when subjected to a lateral load of from 5 to 30 tonnes.

2. A centraliser as claimed in claim 1, wherein said lateral load is from 10 to 25 tonnes.

3. A centraliser as claimed in claim 2, wherein said lateral load is from 18 to 22 tonnes.

4. A centraliser as claimed in claim 1, wherein said rigid member is of generally U-shape cross-section.

5. A centraliser as claimed in claim 1, wherein said rigid member comprises a crushable material.

6. A centraliser as claimed in claim 5, wherein said rigid member is provided with a reinforcing member.

7. A centraliser as claimed in claim 6, wherein said reinforcing member comprises plastics material.

8. A centraliser as claimed in claim 6, wherein said reinforcing member co-operates with said crushable material to inhibit broken pieces of said rigid member separating from said centraliser.

9. A centraliser which comprises a first member which can be mounted around a length of casing, a second member which can be mounted around said casing, and a plurality of rigid members which extend between said first member and said second member, each of said rigid members being of generally U-shape cross-section and, when said centraliser is mounted on a length of casing, substantially irreversibly collapsible against said casing when subjected to a lateral load of from 10 to 25 tonnes.

10. A centraliser which comprises a first member which can be mounted around a length of casing, a second member which can be mounted around said casing, and a plurality of rigid members which extend between said first member and said second member, each of said rigid members comprising a crushable material provided with a reinforcing member, and, when said centraliser is mounted on a length of casing, each of said reinforcing members substantially irreversibly collapsible against said casing when subjected to a lateral load of from 10 to 25 tonnes.

11. A centraliser as claimed in claim 10, wherein said reinforcing members comprise plastics material.

12. A centraliser as claimed in claim 10, wherein said reinforcing members co-operate with said crushable material to inhibit broken pieces of said rigid member separating from said centraliser.

* * * * *